US006698324B2

(12) United States Patent
Hashimoto et al.

(10) Patent No.: US 6,698,324 B2
(45) Date of Patent: Mar. 2, 2004

(54) PUNCH UNIT FOR PUNCHING A HOLE IN A SOFT METAL SHEET

(75) Inventors: Hidekazu Hashimoto, Shimane (JP); Junichi Nakao, Tottori (JP); Kazuoki Komiyama, Kanagawa (JP)

(73) Assignees: Hitachi Metals, Ltd., Tokyo (JP); HMY, Ltd., Shimane (JP); Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/769,285

(22) Filed: Jan. 26, 2001

(65) Prior Publication Data

US 2001/0011493 A1 Aug. 9, 2001

(30) Foreign Application Priority Data

Jan. 26, 2000 (JP) ..... 2000-016880

(51) Int. Cl.[7] ..... B26D 7/00; B26F 1/14
(52) U.S. Cl. ..... 83/167; 83/686
(58) Field of Search ..... 83/140, 686, 167

(56) References Cited

U.S. PATENT DOCUMENTS

| | | | | | |
|---|---|---|---|---|---|
| 155,347 | A | * | 9/1874 | Tucker | 83/686 |
| 211,619 | A | * | 1/1879 | Campbell | 83/167 |
| 374,464 | A | * | 12/1887 | Farrin | 83/686 |
| 524,691 | A | * | 8/1894 | McLane | 83/622 |
| 706,279 | A | * | 8/1902 | Temple | 83/140 |
| 1,384,696 | A | * | 7/1921 | Gray | 83/140 |
| 1,431,641 | A | * | 10/1922 | Erickson | 83/145 |
| 1,594,155 | A | * | 7/1926 | Dunfey | 83/167 |
| 1,665,805 | A | * | 4/1928 | Walter | 83/686 |
| 1,847,273 | A | * | 3/1932 | Stacey | 83/387 |
| 2,431,567 | A | | 11/1947 | Kopczynski et al. | |
| 2,708,970 | A | * | 5/1955 | Taylor | 83/140 |
| 2,882,971 | A | * | 4/1959 | Bennett et al. | 83/140 |
| 3,170,349 | A | * | 2/1965 | Weinkle | 83/140 |
| 3,465,634 | A | * | 9/1969 | Blais | 83/695 |
| 3,469,481 | A | * | 9/1969 | Cloup | 83/140 |
| 3,779,113 | A | * | 12/1973 | Jestin | 83/140 |
| 4,007,653 | A | | 2/1977 | Cady | |
| 4,166,403 | A | | 9/1979 | DiDonate, Jr. et al. | |
| 4,420,314 | A | | 12/1980 | Teeslink | |
| 4,257,292 | A | | 3/1981 | Faull | |
| 4,696,211 | A | | 9/1987 | Bitzel | |
| 4,987,811 | A | * | 1/1991 | Ikarashi et al. | 83/687 |
| 5,025,691 | A | * | 6/1991 | Deni | 83/140 |
| 5,056,392 | A | | 10/1991 | Johnson et al. | |
| 5,176,057 | A | | 1/1993 | Chun et al. | |
| 5,214,991 | A | | 6/1993 | Shimizu et al. | |
| 5,259,225 | A | | 11/1993 | Koch | |
| 5,438,897 | A | | 8/1995 | Chun | |
| 5,444,908 | A | | 8/1995 | Kazino | |
| 5,632,188 | A | * | 5/1997 | Karlis | 83/167 |
| 5,697,278 | A | * | 12/1997 | Shun-Yi | 83/686 |
| 5,752,424 | A | | 5/1998 | Rosene et al. | |
| 5,839,341 | A | | 11/1998 | Johnson et al. | |
| 5,871,788 | A | * | 2/1999 | Foldesi et al. | 83/686 X |
| 5,943,934 | A | | 8/1999 | Codatto | |
| 6,076,447 | A | * | 6/2000 | Damask | 83/167 |
| 6,152,005 | A | | 11/2000 | Ootsuka | |
| 6,289,709 | B1 | * | 9/2001 | Geurts | 83/140 |
| 6,367,362 | B1 | * | 4/2002 | Brazell et al. | 83/686 |

FOREIGN PATENT DOCUMENTS

| | | |
|---|---|---|
| JP | 11-188429 | 7/1999 |

* cited by examiner

*Primary Examiner*—Allan N. Shoap
*Assistant Examiner*—Jason Prone
(74) *Attorney, Agent, or Firm*—Sughrue Mion, PLLC

(57) ABSTRACT

A punch unit (1) is provided with: a punch (2), which is reciprocally driven in a punching operation; and, a die (3), which cooperates with the punch (2) in punching a hole in a soft metal sheet (i.e., workpiece not shown). In this punch unit (1): punch guides (12, 13*a*) and the die (3) are integrally formed into a punch block (11); and a radial clearance between the punch (2) and the die (3) is set at a value of from 4 to 15% of a thickness of the soft metal sheet to be punched; and, the punch unit (1) is further provided with a sheet hold-down means (5) the sheet hold-down means (5) functioning to hold down the soft metal sheet when the soft metal sheet is punched.

6 Claims, 4 Drawing Sheets

PUNCH UNIT FOR PUNCHING A HOLE IN A SOFT METAL SHEET

BACKGROUND OF THE INVENTION

1. Field of the Invention

The present invention relates to a punch unit for punching a hole (hereinafter referred to as "punch hole") in a soft metal sheet such as an aluminum sheet and the like (hereinafter also referred to as "workpiece"), wherein the punch hole assumes a circular shape or any other suitable shape, and the soft metal sheet having been punched is used in preparing a printing plate in the field of printing plate making.

2. Description of the Related Art

Heretofore, in order to punch a soft metal sheet such as an aluminum sheet and the like used in preparing a printing plate in the field of lithographic printing plate making, a punch unit of a reciprocating type has been used as is in the case where a piece of paper is punched as a workpiece.

However, in case that the soft metal sheet such as the aluminum sheet and the like is punched by using a conventional punch unit heretofore having been used in punching a piece of paper, the conventional punch unit has its punch and its die remarkably shortened in service life. Further, in the case of the conventional punch unit, the soft metal sheet tends to stick to the punch when punched, which impairs the quality of a punch hole of the soft metal sheet thus punched. This is a problem inherent in the conventional punch unit.

In order to solve this problem, it is necessary and important to set a radial clearance between the punch and the die at an appropriate value. However, in the conventional punch unit, a punch guide and a die block thereof are formed into two different components, and then assembled into a die assembly by using suitable fastening means such as rivets, screws and the like. Due to this, it is difficult for the conventional punch unit to precisely control the radial clearance between the punch and the die. When the punch is deviated from its correct position with respect to the corresponding die, a punch hole of the soft metal sheet thus punched becomes poor in quality.

SUMMARY OF THE INVENTION

Consequently, it is an object of the present invention to provide a punch unit for punching a precise high-quality punch hole in a soft metal sheet in a steady manner.

In accordance with a first aspect of the present invention, the above object of the present invention is accomplished by providing:

In a punch unit of a reciprocating type provided with a punch and a die both adapted to punch a punch hole in a soft metal sheet, wherein the punch is slidably guided by a punch guide and reciprocally driven in a condition in which the die cooperates with the punch, the improvement wherein: the punch guide and the die are integrally formed into a block.

As described above, in the conventional punch unit, since the die unit is constructed of two different components, that is, the punch guide and the die block which are assembled into the die assembly by using suitable fastening means such as rivets, screws and the like, it is difficult to precisely control the radial clearance between the punch and the die when the soft metal sheet is punched. Further, in the conventional punch unit, there is a fear that the punch deviates from its correct position with respect to the die since the die assembly assembled from two different components is relatively poor in rigidity.

In contrast with this, in the punch unit of the present invention, such two different components, that is, the punch guide and the die are integrally formed into a single block. Due to this, the punch unit of the present invention is excellent in rigidity, which solves the above fear inherent in the conventional punch unit.

In accordance with a second aspect of the present invention, the above object of the present invention is accomplished by providing:

the punch unit as set forth in the first aspect of the present invention, wherein the punch guide comprises:

a lower guide for guiding the punch in the side of the die, wherein the lower guide is provided with a through-hole window, the through-hole window extending in a direction perpendicular to a longitudinal axis of a bore of the lower guide, whereby an upper portion of the through-hole window forms the lower guide and a lower portion of the through-hole window forms a gate, the gate serving as a part of the cleaning means for removing the fragment of the soft metal sheet from the punch in the punching operation; and an upper guide for guiding the punch in its driven side.

In the punch unit of the present invention has the above construction, when the punch is reciprocally driven in a vertical plane to punch a punch hole in the soft metal sheet, the fragment of the soft metal sheet having stuck to the punch is scraped off the punch by the cutting edge portion of the gate and discharged outward through a workpiece passage and the through-hole window. Consequently, in the punching operation, it is possible to reduce a frictional drag of the punch caused by such fragment of the soft metal sheet. This also improves the punch hole in quality. Since the gate serves as a cleaning blade during the punching operation, it is possible to reduce the gate in thickness.

Preferably: the soft metal sheet has a thickness of less than or equal to 0.5 mm; and, a radial clearance between the punch and the die is set at a value of from 4 to 15% of a thickness of the soft metal sheet.

In the conventional punch unit for punching a piece of paper and the like, a radial clearance between the punch and the die is set at a value of from 5 to 10 $\mu$m. Consequently, when a soft metal sheet such as an aluminum sheet and the like, has a thickness less than 0.5 mm is punched by using the conventional punch unit, a secondary shearing action occurs in the punch hole to have the soft metal sheet often stick to the punch, which prevents the punch from producing a high-quality punch hole and considerably reduces the service life of each of the punch and the die.

In view of the above problems, in the punch unit of the present invention, when the sheet has a thickness less than 0.5 mm is punched, a radial clearance between the punch and the die is set at a value of from 4 to 15% of a thickness of the soft metal sheet, which enables the punch unit of the present invention to punch a high-quality punch hole in the soft metal sheet under its shearing action. The reason why the radial clearance between the punch and the die is set at the above value of from 4 to 15% of a thickness of the soft metal sheet is as follow: namely, when the radial clearance is less than or equal to 4% of the thickness of the soft metal sheet, the punch tends to gall the die. On the other hand, when the radial clearance is more than 15% of the thickness of the soft metal sheet, burrs are produced in the punch hole. Preferably, the radial clearance between the punch and the die should be set at a value of from 6 to 12% of the thickness of the soft metal sheet. In case that the soft metal sheet has a thickness of 0.3 mm for example, the radial clearance should be set at a value of 30±5 μm.

Preferably, the punch unit of the present invention is further provided with a sheet hold-down means for holding down the soft metal sheet when the soft metal sheet is punched, which improves the punch hole in quality.

After the soft metal sheet is punched, the soft metal sheet thus punched tends to stick to the punch due to its softness when the punch is retracted from the soft metal sheet. Such sticking action of the soft metal sheet to the punch often results in formation of burrs, wherein such burrs assume a lampshade-like shape as a whole and project outward from a peripheral portion of the punch hole. This prevents the punch hole from being improved in quality and produced in a steady manner.

In view of the above problem, the sheet hold-down means is introduced in the punch unit of the present invention for holding down the soft metal sheet when the sheet is punched, so that the soft metal sheet thus punched is prevented from being lifted by the punch after completion of the punching operation thereof, whereby the punch hole is improved in quality.

Preferably, in the punch unit of the present invention, the punch is provided with a cutting edge portion assuming a circularly-curved shape in its font end portion for improving the quality of the punch hole.

Heretofore, as shown in an upper portion of FIG. 7A, a conventional punch has been provided with a wedge-shaped cutting edge portion 2*a*' in its front end portion in order to reduce a punching load imposed on the punch in a punching operation of a workpiece. However, when the workpiece is punched by using such a conventional punch to form a punch hole, a pair of notches "g" are often formed in a peripheral portion of the punch hole to impair the quality of the punch hole, as shown in a lower portion of FIG. 7A. The cause found by the inventor of the present invention for such formation of the notches "g" in the peripheral portion of the punch hole is the presence of a wedge-shaped concave bottom portion "e" in a front end portion of the conventional punch, which concave bottom portion "e" of the conventional punch locally hits the workpiece at the end of the punching operation of the workpiece to produce these defective notches "g". In view of the above, in the punch unit of the present invention, as shown in an upper portion of FIG. 7B, a circularly-curved cutting edge portion 2*a* (a radius of which is denoted by the reference letter "R") is provided in a front end portion of its punch. Since the punch of the punch unit of the present invention has such circularly-curved cutting edge portion 2*a* in its front end, it is possible for the punch unit of the present invention to prevent the punch from locally hitting the workpiece (i.e., the soft metal sheet). This prevents the notches "g" from being formed in the peripheral portion of the punch hole formed in the soft metal sheet by using the punch unit of the present invention. Consequently, it is possible for the punch unit of the present invention to solve the above problem inherent in the conventional punch.

The punch unit of the present invention is most effectively used when the workpiece or soft metal sheet to be punched is made of aluminum or aluminum alloys.

As described above, the punch unit of the present invention is capable of punching a high-quality punch hole in the soft metal sheet, and also capable of remarkably increasing the service life of each of its punch and its die. Consequently, it is possible for the punch unit of the present invention to remarkably improve a punching operation of an aluminum sheet and the like in accuracy and productivity, which punching operation is required to produce a printing plate.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
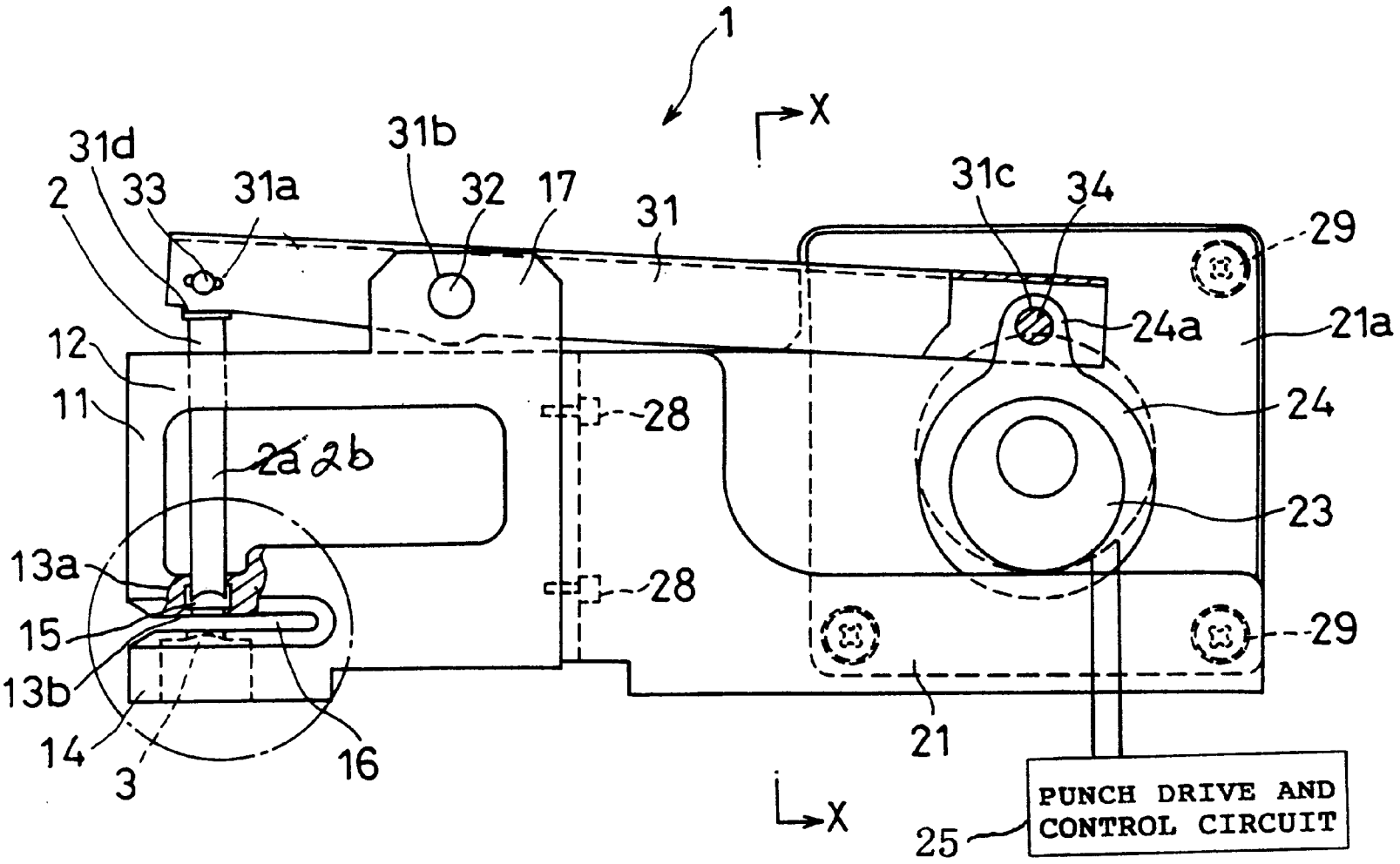
FIG. 1 is a front view of an embodiment of the punch unit of the present invention for punching a punch hole in the soft metal sheet, wherein a sheet hold-down means of the punch unit is removed.

The best modes for carrying out the present invention will be described in detail using embodiments of the present invention with reference to the accompanying drawings.

The present invention may, however, be embodied in various different forms and should not be construed as limited to the embodiments set forth herein; rather, these embodiments are provided so that this disclosure will be thorough and complete, and will fully convey the scope of the present invention to those skilled in the art.

In the accompanying drawings, like reference numerals refer to like parts throughout the drawings.

First Embodiment

A first embodiment of a punch unit 1 of the present invention for punching a punch hole in a soft metal sheet will be described with reference to the drawings.

With reference to FIG. 1, a main frame of the punch unit 1 will be first described in construction. As shown in FIG. 1, the punch unit 1 is constructed of: a punch block 11 which is integrally formed with an upper punch guide 12, a lower punch guide 13*a* and a die block 14; and, a motor bracket 21 on which a motor 22, a drive portion 23 and like components are mounted. As is clear from FIG. 1, the motor bracket 21 is fixedly mounted on the punch block 11 by using of a plurality of screws 28 to form the main frame of the punch unit 1.

The punch block 11 assumes a substantially hollow square block shape, and is provided with a horizontal workpiece passage 16 in a left corner portion of its lower section, as viewed in FIG. 1. As is clear from FIG. 1, this horizontal workpiece passage 16 has a workpiece-receiving opening formed in its left end portion. Further, preferably, the workpiece-receiving opening of the passage 16 is chamfered in a manner shown in FIG. 1 to facilitate entrance of the workpiece (i.e., a soft metal sheet) to the passage 16.

The upper punch guide 12 and the lower punch guide 13*a* represent an upper guide bore and a lower guide bore, respectively. Consequently, hereinafter, the upper guide bore and the lower guide bore will be referred to as the guide bores 12 and 13*a*, respectively. These guide bores 12, 13*a* are formed as through-holes passing through the punch block 11 in a manner such that the guide bores 12, 13*a* extend in a direction perpendicular to a plane in which the workpiece (i.e., soft metal sheet) extends. As is clear from FIG. 1, the lower guide bore 13*a* is disposed adjacent to an upper portion of the workpiece passage 16. On the other hand, the upper guide bore 12 is disposed above and spaced apart from the lower guide bore 13*a* in the punch block 11, so that these guide bores 12, 13*a* function to slidably receive therein and guide the punch 2 in the punching operation thereof.

In the vicinity of the workpiece passage 16, there is provided a through-hole window 15. This window 15 extends in a direction perpendicular to a longitudinal axis of the lower guide bore 13*a*. In other words, an upper portion of this window 15 forms the lower guide bore 13*a*. On the other hand, a lower portion of the window 15 is disposed adjacent to the workpiece passage 16 to form a gate 13*b*. The gate 13*b* has a bore diameter which is slightly larger or substantially equal to a diameter of a cutting edge portion of the punch 2. Due to the presence of the gate 13*b*, it is possible for the punch unit 1 to remove therefrom any fragment of the workpiece having stucked to the punch 2 by using an edge portion of the gate 13*b* when the punch is moved up and down in the punching operation of the workpiece. The thus removed fragment of the workpiece is then discharged out of the punch unit 1 through both the workpiece passage 16 and the through-hole window 15, so that frictional drag of the punch 2 due to the presence of the fragment stuck thereto is remarkably reduced in the punch unit 1. Incidentally, since the gate 13*b* serves as a cleaning blade, it is possible for the gate 13*b* to have its wall thickness be small.

In the punch unit 1 having the above construction, the punch 2 has its upper and its lower portion slidably received in the upper guide bore 12 and the lower guide bore 13*a*, respectively. Consequently, it is possible for the punch unit 1 to move the punch 2 up and down with high accuracy in the punching operation with respect to a radial clearance between the punch 2 and the die 3, which ensures that the punch unit 1 forms a high-quality punch hole in the workpiece, i.e., soft metal sheet.

As shown in FIG. 1, a bearing unit 17 is provided in an upper section of the punch block 11 to pivotally support a swing arm 31 through a pivot 32 therein.

The die block 14 is integrally formed with a lower portion of the workpiece passage 16 to form the die 3.

In contrast with this, in the conventional punch unit for punching a punch hole in a piece of paper and the like, in general, its punch guides and its die block are formed into different components. Such different components are then assembled and used in the conventional punch unit.

On the other hand, in the punch unit 1 of the present invention, since the punch guides 12, 13*a* and die block 14 are integrally formed into a single piece of the punch block 11, it is possible to have the punch 2 and the die 3 aligned in center with each other with high accuracy, which permits the radial clearance between the punch 2 and the die 3 to be set at an appropriate value. Further, such one-piece punch block 11 is excellent in rigidity, which effectively prevents the punch guides 12, 13*a* from deviating in center with respect to the bore of the die 3 and ensures that a high-quality punch hole is formed in the workpiece (i.e., soft metal sheet).

Figure 4:
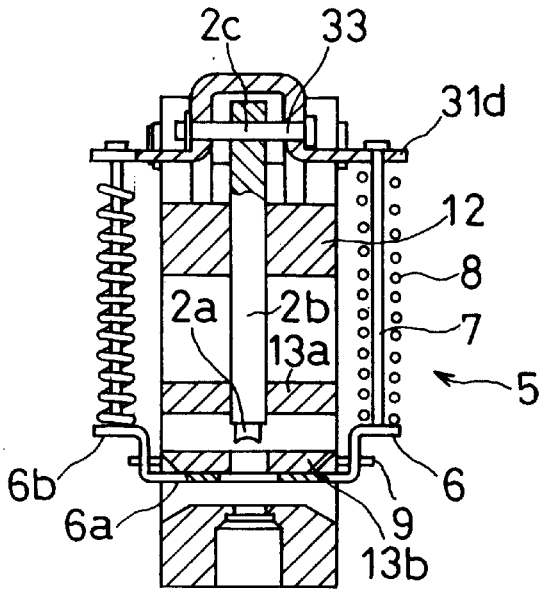
FIG. 4 is a cross-sectional view of the punch unit of the present invention, taken along the line Y—Y of FIG. 3.
Figure 5:
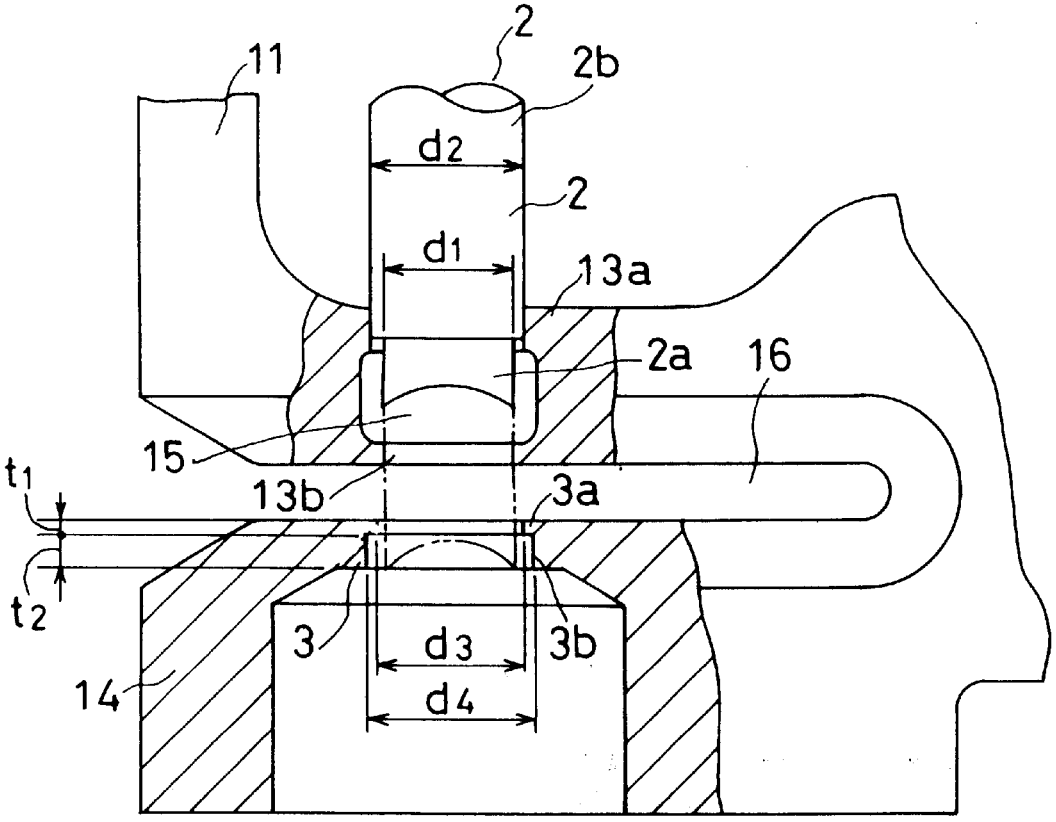
FIG. 5 is a partially enlarged front view of a die portion of the punch unit of the present invention shown in FIG. 1.

As shown in FIG. 5, the punch 2 assumes a stepped-shape in its lower portion in which: the cutting edge portion 2*a* of the punch 2 has a diameter of "$d_1$"; and, a shaft portion 2*b* of the punch 2 has a diameter of "$d_2$" which is larger than the diameter of the cutting edge portion 2*a* of the punch 2. The shaft portion 2*b* of the punch 2 is slidably received in both the upper punch guide 12 and the lower punch guide 13*a*. As shown in FIG. 4, a through-hole 2*c* is formed in an upper portion of the shaft portion 2*b* of the punch 2 to extend in a direction perpendicular to the longitudinal axis of the punch 2. On the other hand, the swing arm 31 is provided with a pair of elongated holes 31*a* together with a plurality of through-holes 31*b*, 31*c*, and has the elongated holes 31*a* aligned in center with the through-hole 2*c* of the punch 2 to permit a punch pin 33 to pass therethrough, as shown in FIG. 4. Through this punch pin 33, the punch 2 is rotatably connected with a front end portion (i.e., follower end portion) of the swing arm 33.

In order to align the punch 2 in center with the die 3, preferably, both the punch guide bores 12, 13*a* and the bore of the die 3 are simultaneously formed. Due to this, in the stepped-shape of the punch 2 shown in FIG. 5, the diameter "$d_1$" of the cutting edge portion 2*a* of the punch 2 is preferably smaller than the diameter "$d_2$" of the shaft portion 2*b* of the punch 2. By using the punch 2 assuming such stepped-shape, it is possible for the punch unit 1 of the present invention to stabilize engagement between the punch guide bores 12, 13*a* and the shaft portion 2*b* of the punch 2 with high accuracy, and therefore possible to set the radial clearance between the punch 2 and the die 3 at an appropriate value, which ensures that a high-quality punch hole is formed in the workpiece or soft metal sheet by using the punch unit 1.

Figure 7A:
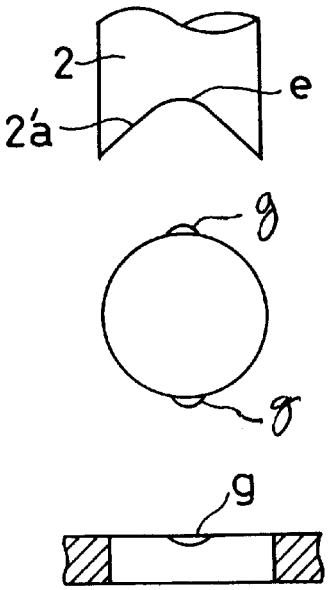
FIG.7A(PRIOR ART)
FIG. 7A is a front view of a conventional punch, illustrating the shape of a cutting edge portion of the conventional punch and its effect.
Figure 7B:
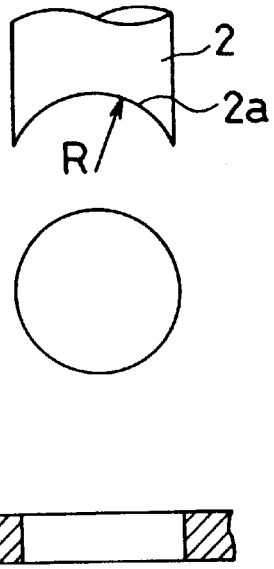
FIG. 7B is a front view of the punch of the punch unit of the present invention, illustrating the shape of a cutting edge portion of the punch and its effect.

Further, as shown in FIGS. 5 and 7B, in the punch unit 1, since the cutting edge portion 2*a* of the punch 2 assumes the circularly-curved shape (a radius of which is represented by "R" shown in FIG. 7B), it is possible for the punch unit 1 to prevent the defective notches from being formed in the peripheral portion of the punch hole, in which peripheral portion the punch 2 hits the soft metal sheet (i.e., workpiece) at the end of the punching operation.

FIG. 5 shows the details of the die block 14, provided in which is the die 3 having a cutting edge portion 3*a*. This cutting edge portion 3*a* is coaxially arranged with the punch guide bores 12, 13*a*, and has a diameter of "$d_3$". Disposed under the cutting edge portion 3*a* of the die 3 is an undercut portion 3*b* having a diameter of "$d_4$" which is larger than the diameter "$d_3$" of the cutting edge portion 3*a* of the die 3. In the punch unit 1, the radial clearance between an outer peripheral surface of the punch 2 and an inner peripheral surface of the bore of the die 3 is set at a value of from 4 to 15% of a thickness of the soft metal sheet (workpiece) In other words, the relationship between the outer diameter "$d_1$" of the cutting edge portion 2*a* of the punch 2 and the inner diameter "$d_3$" of the bore of the die 3 may be defined in the following equation:

$$(d_3-d_1)/2=(T\times\text{a value of from 4 to 15})/100$$

where:

T is a thickness of the soft metal sheet (workpiece)

Preferably, the radial clearance between the punch 2 and the die 3 is set at a value of from 6 to 12% of the thickness of the soft metal sheet.

In contrast with this, in the conventional punch unit for punching a punch hole in a piece of paper and the like, such radial clearance between the punch and the die is set at a value of from 5 to 10 $\mu$m. However, when the conventional punch unit is used to punch the soft metal sheet, a secondary shearing action occurs in the punch hole to have a fragment of the soft metal sheet often stick to the punch, which prevents the punch from producing a high-quality punch hole and considerably reduces the service life of each of the punch and the die. In the conventional punch unit, due to the presence of such fragment stuck to the punch, the punch suffers from a considerable frictional drag during the punching operation of the soft metal sheet, which often stops the operation of the punch. However, it is possible to solve this problem of the frictional drag of the punch by using the punch unit 1 of the present invention.

In the punch unit 1 of the present invention, a thickness of the cutting edge portion 3*a* of the die 3 is represented by the reference letter and numeral "$t_1$". Although the thickness "$t_1$" of the cutting edge portion 3*a* of the die 3 is preferably set at the smallest possible value in order to reduce its interference area (i.e., frictional contact area) with the punch 2, it is necessary for the cutting edge portion 3*a* of the die 3 to withstand a punching load imposed thereon during the punching operation. Due to this necessity, the punch unit 1 of the present invention uses a value of from 0.5 to 1.2 mm as the thickness of the cutting edge portion 3*a* of the die 3. The diameter "$d_3$" of the undercut portion 3*b* disposed under the lower portion of the cutting edge portion 3*a* of the die 3 is set at a value slightly larger than the inner diameter "$d_1$" of the bore of the die 3 to permit a chad (i.e., a small metal piece formed when the punch hole is punched in the soft metal sheet, i.e., workpiece) to freely drop out of the undercut portion 3*b*.

Figure 6:
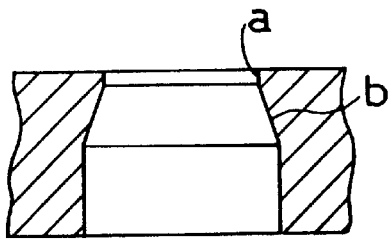
FIG. 6 is a cross-sectional view of another embodiment of the die portion of the punch unit of the present invention shown in FIG. 5.

In the first embodiment, though the die 3 assumes a two-stepped bore shape, it is also possible for the die 3 to assume any other shape, for example such as one shown in FIG. 6, in which one: a land portion "a" and an undercut angle portion "b" are provided.

On the other hand, the motor bracket 21 is formed of a metal plate, and assumes a U-shaped form. The motor bracket 21 and the punch block 11 are assembled together using a plurality of screws 28. The motor bracket 21 is provided with an end plate portion 21*a* on which the motor 22 is fixedly mounted using four pieces of screws 29.

A thickness of the undercut portion 3*b* is represented by the reference letter and numeral "$t_2$".

An eccentric cam 23 is fixedly mounted on a rotating shaft of a motor 22. On the other hand, a link 24 is rotatably mounted on an outer peripheral surface of this eccentric cam 23. The link 24 is provided with a link opening 24*a*. This link opening 24*a* is aligned in center with the through-holes 31*c* of a drive end portion of the swing arm 31 to permit a link pin 34 to pass therethrough, so that the link 24 is rotatably engaged with the swing arm 31 through the link pin 34.

Figure 2:
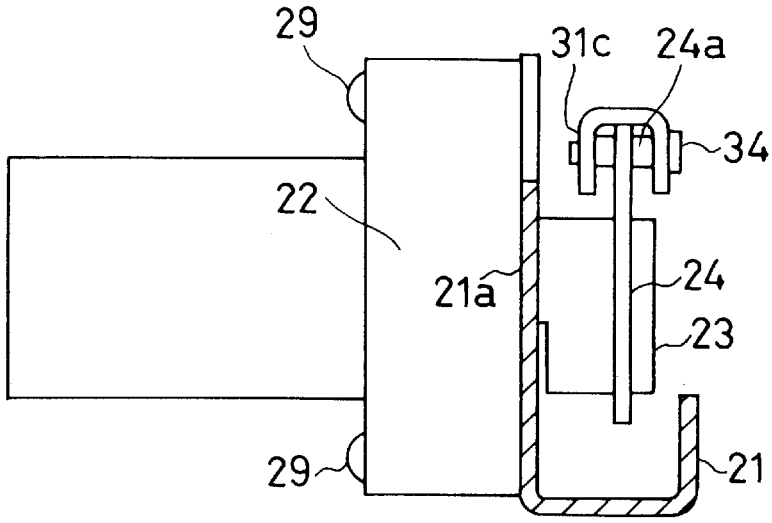
FIG. 2 is a cross-sectional view of the punch unit of the present invention, taken along the line of X—X of FIG. 1.

As shown in FIG. 2, the swing arm 31 assumes a channel-like shape in cross section, and has its follower end portion disposed in the side of the punch 2. The swing arm 31 has an intermediate portion of this follower end portion rotatably mounted on the pivot 32. This pivot 32 passes through the bearing unit 17 disposed in the upper portion of the punch block 11. The follower end portion of the swing arm 31 is provided with the elongated holes 31*a* which are aligned in center with the through-hole 2*c* of the punch 2 to rotatably receive therein the punch pin 33 in a manner such that the punch 2 is capable of moving up and down. On the other hand, as described above, the drive end portion of the swing arm 31 is rotatably engaged with the link 24. Further, as is clear from FIG. 4, the follower end portion of the swing arm 31 is provided with a pair of fin portions 31*d*. Each of these fin portions 31*d* is used to suspend therefrom a hanging rod 7 through which the sheet hold-down means 5 is supported so as to be movable up and down.

On the other hand, the motor 22 is energized and controlled by a motor drive and control means or circuit 25 (shown in FIG. 1). When the eccentric cam 23 is rotatably driven by the motor 22, the swing arm 31 is swingably driven on the pivot 32 by the eccentric cam 23 through the link 24 and the link pin 34. As a result, the punch 2 is reciprocally driven by the swing arm 31 through the elongated holes 31*a* and the punch pin 33 so as to be moved up and down. Due to this arrangement, it is possible for the punch unit 1 to punch a high-quality punch hole in the workpiece or soft metal sheet (not shown) having been inserted into the workpiece passage 16. After completion of the punching operation, a detection means (not shown) detects a predetermined angular position of the eccentric cam 23. According to detection of such predetermined angular position of the eccentric cam 23, the motor stops in operation to have the punch 2 stopped at its upper dead point corresponding to a standby position of the punch 2.

Further, the punch drive and control circuit 25 is also capable of energizing the motor 22 in a manner such that the motor 22 permits the punch 2 to perform its lost motion at predetermined time intervals. For example, after every 10 times of punching operations of the workpiece or soft metal sheet, the punch 2 performs its lost motion three times to remove the fragment of the soft metal sheet having stuck to the punch 2 by using the upper and the lower edge of the gate 13*b*, which enables the punch 2 to perform its cleaning operation. Alternatively, it is also possible for the punch unit 1 to permit an operator to turn on a switch (not shown) at the beginning of the punching operation or to turn off the switch (not shown) at the end of the punching operation, so that the punch 2 performs its automatic lost motion to clean itself.

In the punch unit 1 having the above construction, when the eccentric cam 23 is rotatably driven by the motor 22, the swing arm 31 is swingably driven on the pivot 32 by the eccentric cam 23 through the link 24 and the link pin 34. As a result, the swing arm 31 drives the punch 2 through the elongated holes 31*a* and the punch pin 33 in a manner such that the punch 2 moves up and down. Due to this, the workpiece or soft metal sheet (not shown) having inserted into the workpiece passage 16 is punched by the punch 2. After completion of the punching operation, the detection means (not shown) detects the predetermined angular position of the eccentric cam 23 to stop the motor 22 in a manner such that the punch 2 is stopped at its upper dead point corresponding to the standby position of the punch 2.

Figure 3:
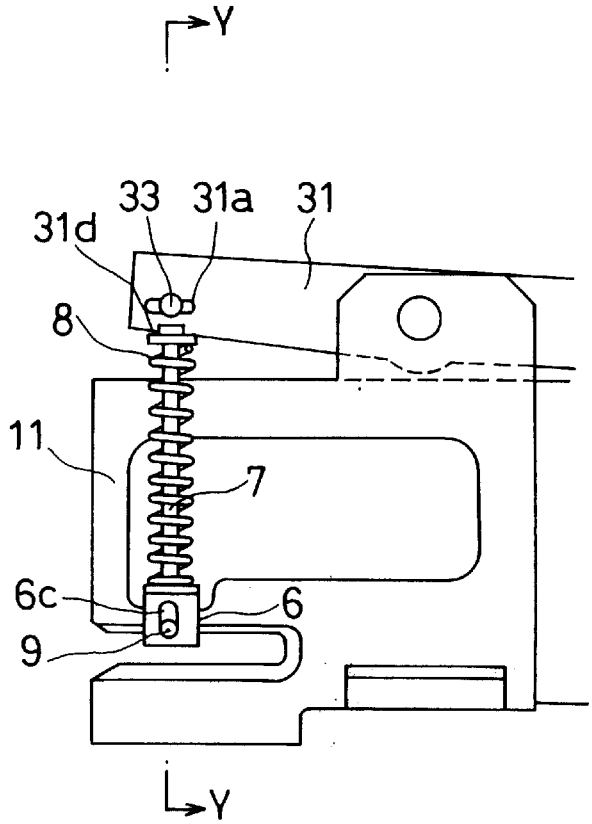
FIG. 3 is a front view of the punch unit of the present invention shown in FIG. 1, illustrating the sheet hold-down means of the punch unit.

Now, the sheet hold-down means 5 of the punch unit 1 will be described in detail with reference to FIGS. 3 and 4. FIG. 3 is a front view of the punch unit 1, illustrating the sheet hold-down means 5. On the other hand, FIG. 4 is a cross-sectional view of the punch unit 1, taken along the line Y—Y of FIG. 3.

The sheet hold-down means 5 is capable of holding down the soft metal sheet when the punch 2 is pulled upward after completion of the punching operation of the soft metal sheet, which enables the punch 2 to remove the fragment of the soft metal sheet therefrom, whereby the punch hole thus formed in the soft metal sheet is remarkably improved in quality.

As shown in FIGS. 3 and 4, the sheet hold-down means 5 is provided with a hold-down plate 6. The hold-down plate 6 is constructed of: a bottom hold-down portion 6*a*; a pair of upright portions adjacent to opposite end portions of the bottom hold-down portion 6*a*; and, a pair of horizontal support portions 6*b* each of which has its inner end portion integrally connected with an upper end portion of each of the upright portions. As a result, the hold-down plate 6 assumes a dish-like shape as a whole, and is provided with a through-hole in its central portion, through which through-hole the punch 2 is capable of freely passing through the hold-down plate 6. Further, as is clear from FIG. 4, the hold-down plate 6 has each of its support portions 6*b* supported by each of the hanging rods 7 in a manner such that the hold-down plate 6 is vertically movable along the lengths of the hanging rods 7. On the other hand, each of the hanging rods 7 is connected with each of the fin portions 31*d* of the follower end portion of the swing arm 31.

As shown in FIG. 4, the sheet hold-down plate 6 has its upper surface disposed adjacent to a lower surface of the gate 13*b*, and is provided with a vertically elongated hole 6*c* (shown in FIG. 3) in each of its upright portions. Passed through such vertically elongated holes 6*c* of the sheet hold-down plate 6 are a pair of pins 9. These pins 9 are embedded in opposite side surfaces of the gate 13*b*, horizontally extend outward therefrom, and pass through the vertically elongated holes 6*c* of the sheet hold-down plate 6 to serve as guide means for guiding the hold-down plate 6 when the hold-down late 6 moves up and down during the punching operation. Movably mounted between the fin portions 31*d* of the swing arm 31 and the support portions 6*a* of the sheet hold-down plate 6 are pair of compression coil springs 8. The compression coil springs 8 force the sheet hold-down plate 6*b* to be resiliently separated from the fin portions 31*d* of the swing arm 31.

In the punch unit 1 of the present invention having the above construction, at the beginning of the punching operation, the swing arm 31 is swung on the pivot 32 counterclockwise to drive the punch 2 downward. As a result, the sheet hold-down plate 6 is also moved downward through the compression coil springs 8 to hold down the soft metal sheet (i.e., workpiece). After that, the punch 2, is further moved downward to punch a punch hole in the soft metal sheet. During this punching operation, the sheet hold-down plate 6 continues to hold down the soft metal sheet.

After completion of the punching operation, the swing arm 31 begins to swing on the pivot 32 clockwise, so that the punch 2 also begins to move upward. However, the compression coil springs 8 continue to exert their resilient forces on the sheet hold-down plate 6 until the soft metal sheet (workpiece) is separate from the punch 2. Due to this, the soft metal sheet thus punched is still urged downward by the sheet hold-down plate 6 even after completion of the punching operation. In other words, the sheet hold-down plate 6 forces the soft metal sheet to be separated from the punch 2 when the punch 2 is moved upward after completion of the punching operation.

As a result, the soft metal sheet thus punched is separated from the punch 2. When the soft metal sheet is separated from the punch 2, the sheet hold-down plate 6 is also moved upward by the hanging rods 7 as the swing 31 continues swinging on the pivot 32 clockwise. Consequently, when the punch 2 is moved upward, the soft metal sheet (not shown) having stuck to the punch 2 is removed from the punch 2. Due to this, in the punch unit 1, there is no fear that the peripheral portion of the punch hole is partially extended upward to produce defective burrs in the peripheral portion of the punch hole. This makes it possible for the punch unit 1 to punch a high-quality punch hole in the soft metal sheet (i.e., workpiece).

In the above embodiments, though the punch hole assumes a circular shape, it is also possible for the punch hole to assume any other shape, for example such as a square shape, a rectangular shape, an oval shape, an elongated round shape, a keyhole shape and the like.

EXAMPLE

The punch unit of the present invention for punching a punch hole in a soft metal sheet was used to punch a punch hole having a diameter of 6 mm in each of a first and a second sheet both made of pure aluminum (hereinafter referred to as the first and the second aluminum sheet) having a thickness of 0.2 mm and a thickness of 0.3 mm, respectively. A radial clearance between the punch and the die in the punch unit of the present invention was 15 $\mu$m (which corresponds to 7.5% of the thickness of the first aluminum sheet) when the first aluminum sheet having a thickness of 0.2 mm was punched. On the other hand, when the second aluminum sheet having a thickness of 0.3 mm was punched, such radial clearance was 30 $\mu$m (which corresponds to 10.0% of the thickness of the second aluminum sheet).

In contrast with this, when the conventional punch unit for punching a piece of paper and the like was used for punching these aluminum sheets, both the punch and the die of the conventional punch unit were considerably worn out after 500 pieces of punch holes had been formed in these aluminum sheets. Further, the thus worn-out punch and die of the conventional punch unit stuck to the aluminum sheets to fail to continue its further punching operation.

On the other hand, the punch unit of the present invention was found to be capable of continuing its further punching operation even after 30,000 pieces of punch holes had been formed.

As described above, in the punch unit 1 of the present invention, since the punch guides 12, 13*a* and the die 3 are integrally formed into a single punch block 11, the die block 14 of the punch unit is excellent in rigidity. This makes it possible for the punch unit 1 of the present invention to precisely set the radial clearance between the punch 2 and the die 3 at an appropriate value, and also makes it possible to prevent the punch 2 from deviating in position from its correct center line with respect to the center line of the die 3, which ensures that a high-quality punch hole is formed by the punch unit 1 of the present invention.

Further, in the punch unit 1 of the present invention, since the sheet hold-down means 5 is provided therein, there is no fear that the soft metal sheet (i.e., workpiece) stuck to the punch 2 is lifted together with the punch 2 after the punch hole is formed in the soft metal sheet. Due to this, it is possible for the punch unit 1 of the present invention to form a high-quality punch hole in the soft metal sheet.

Further, even when the punch unit 1 of the present invention is used to form a notch in the soft metal sheet, there is no fear that the punch 2 deviates from its center line in the punching operation due to the provision of the punch guide means 12, 13*a* in the punch unit 1, wherein the punch guide means 12, 13*a* functions to keep constant the radial clearance between the punch 2 and the die 3 in the punching operation of the soft metal sheet so that the high-quality punch hole is formed in the soft metal sheet.

Still further, in the punch unit 1 of the present invention, since the punch 2 is provided with the circularly-curved cutting edge portion 2*a* in its front end portion, there is no fear that the defective notches are formed in the peripheral portion of the punch hole of the soft metal sheet in contrast with the case of the conventional punch unit which is provided with the punch having a V-shaped cutting edge portion in its front end portion as shown in FIG. 7A.

Although the punch unit 1 of the present invention for punching the soft metal sheet is capable of punching a sheet (i.e., workpiece) of pure copper and the like, the punch unit of the present invention may be most effectively used when it punches the aluminum sheets or aluminum-alloy sheets, used make a printing plate.

Finally, the present application claims the Convention Priority based on Japanese Patent Application No. 2000-016880 filed on Jan. 26, 2000, which is herein incorporated by reference.

What is claimed is:

1. In a punch unit of a reciprocating type provided with a punch and a die both adapted to punch a punch hole in a soft metal sheet, wherein said punch is slidably guided by a punch guide and reciprocally driven in a condition in which said die cooperates with said punch, wherein:

said punch guide and said die are integrally formed into a one-piece block; and wherein said punch guide comprises:

a lower guide for guiding said punch in the side of said die, wherein said lower guide is provided with a through-hole window, said through-hole window extending in a direction perpendicular to a longitudinal axis of a lower guide bore of said lower guide, wherein an upper portion of said through-hole window forms said lower guide bore and a lower portion of said through-hole window forms a gate, wherein the through-hole window has a diameter larger than the lower guide bore and the gate, said gate for removing said fragment of said soft metal sheet from said punch in said punching operation; and an upper guide for guiding said punch in its driven side.

2. The punch unit as set forth in claim 1, wherein:

said soft metal sheet has a thickness of less than or equal to 0.5 mm; and, a radial clearance between said punch and said die is set at a value of from 4 to 15% of a thickness of said soft metal sheet.

3. The punch unit as set forth in claim 1, wherein the punch unit is further provided with a sheet hold-down means for holding down said soft metal sheet when said soft metal sheet is punched.

4. The punch unit as set forth in claim 1, wherein said punch is provided with a cutting edge portion assuming a circularly-curved shape in its front end portion for improving said punch hole in quality.

5. The punch unit as set forth in claim 1, wherein said soft metal sheet is made of aluminum or aluminum alloys.

6. The punch unit as set forth in claim 5, wherein the soft metal sheet is used for making printing plates.

* * * * *